US010900165B2

(12) United States Patent
Thomas et al.

(10) Patent No.: US 10,900,165 B2
(45) **Date of Patent: *Jan. 26, 2021**

(54) CUTTING GUIDE WITH SEAM ALLOWANCE RECESS

(71) Applicant: USAUS Holdings LLC, Loveland, CO (US)

(72) Inventors: Janna Lee Thomas, Loveland, CO (US); Paul Roger Thomas, Loveland, CO (US)

(73) Assignee: USAUS Holdings LLC, Loveland, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/735,353

(22) Filed: Jan. 6, 2020

(65) Prior Publication Data

US 2020/0141050 A1 May 7, 2020

Related U.S. Application Data

(63) Continuation of application No. 16/054,916, filed on Aug. 3, 2018, now Pat. No. 10,526,747, which is a continuation of application No. 15/280,747, filed on Sep. 29, 2016, now Pat. No. 10,041,206, which is a continuation of application No. 12/584,015, filed on Aug. 28, 2009, now Pat. No. 9,458,566.

(51) Int. Cl.

| | |
|---|---|
| ***D06H 7/06*** | (2006.01) |
| ***D06H 7/04*** | (2006.01) |
| ***B26B 29/06*** | (2006.01) |
| ***D06H 7/02*** | (2006.01) |
| *D06H 7/00* | (2006.01) |

(52) U.S. Cl.

CPC ..... *D06H 7/06* (2013.01); *B26B 29/06* (2013.01); *D06H 7/02* (2013.01); *D06H 7/04* (2013.01); *D06H 7/00* (2013.01); *Y10T 29/49828* (2015.01); *Y10T 83/04* (2015.04)

(58) Field of Classification Search

CPC .. D06H 7/06; D06H 7/02; D06H 7/04; D06H 7/00; B26B 29/06; A47J 47/005

See application file for complete search history.

(56) References Cited

U.S. PATENT DOCUMENTS

| | | | |
|---|---|---|---|
| 816,529 | A | 3/1906 | Burts |
| 1,637,804 | A | 8/1927 | Brooks |
| 2,494,301 | A | 1/1950 | Lowe |
| 3,292,477 | A | 12/1966 | Raftery |
| 3,726,165 | A | 4/1973 | Hendrickson |

(Continued)

FOREIGN PATENT DOCUMENTS

| | | | |
|---|---|---|---|
| DE | 3525959 | 6/1986 | |
| DE | 29701433 U1 * | 5/1997 | ..... B26B 29/06 |

(Continued)

OTHER PUBLICATIONS

English Translation of DE29701433. (Year: 1997).*

(Continued)

*Primary Examiner* — Jennifer B Swinney

(74) *Attorney, Agent, or Firm* — Craig R. Miles; CR Miles P.C.

(57) ABSTRACT

A cutting guide having a seam allowance recess and methods of cutting a piece of material with such cutting guide.

13 Claims, 7 Drawing Sheets

(56) References Cited

U.S. PATENT DOCUMENTS

| | | | |
|---|---|---|---|
| 3,805,720 | A | 4/1974 | Hunt |
| 3,911,584 | A | 10/1975 | Ajus et al. |
| 4,218,947 | A | 8/1980 | Laviola |
| 4,462,168 | A | 7/1984 | Lynch et al. |
| 4,524,522 | A | 6/1985 | Perry |
| 4,646,666 | A | 3/1987 | Burrier |
| 4,741,235 | A | 5/1988 | Price |
| 4,779,346 | A | 10/1988 | Schafer |
| 4,930,382 | A | 6/1990 | Collins |
| 5,138,759 | A | 8/1992 | Gruetzmacher |
| 5,191,716 | A | 3/1993 | Anderson |
| 5,347,724 | A | 9/1994 | Hankins |
| 5,365,822 | A | 11/1994 | Stapleton et al. |
| 5,557,996 | A | 9/1996 | Reber et al. |
| 5,579,670 | A | 12/1996 | McCormick |
| 5,638,605 | A | 6/1997 | Sligar |
| 5,749,149 | A | 5/1998 | Claytor |
| 5,823,086 | A | 10/1998 | McCormick |
| 5,829,150 | A | 11/1998 | McEligot |
| 6,158,135 | A | 12/2000 | Rank |
| 6,276,070 | B1 | 8/2001 | Hawley |
| 6,321,458 | B1 | 11/2001 | Hess |
| 6,434,844 | B1 | 8/2002 | Rank |
| 6,696,129 | B1 | 2/2004 | Cotton |
| 6,799,379 | B2 | 10/2004 | Brady |
| 6,839,971 | B2 | 1/2005 | Schafer et al. |
| 6,854,189 | B2 | 2/2005 | Schafer |
| 6,925,724 | B2 | 8/2005 | Tandy |
| 6,944,963 | B2 | 9/2005 | Amaru |
| 7,028,412 | B2 | 4/2006 | Boomershine |
| 7,032,319 | B2 | 4/2006 | Ollgaard et al. |
| 7,043,850 | B2 | 5/2006 | Brady |
| 7,100,295 | B1 | 9/2006 | Chang |
| 7,134,399 | B1 | 11/2006 | Gulsby |
| 7,185,441 | B2 | 3/2007 | Lockyer |
| 7,383,640 | B2 | 6/2008 | Barry |
| D577,617 | S | 9/2008 | Tucker |
| 7,536,803 | B2 | 5/2009 | Samuels |
| 7,568,295 | B1 | 8/2009 | Strain |
| D601,442 | S | 10/2009 | Haren |
| 9,624,612 | B2 | 4/2017 | Works |
| 2003/0110653 | A1 | 6/2003 | Schafer |
| 2003/0159556 | A1 | 8/2003 | Cleveland et al. |
| 2004/0049935 | A1 | 3/2004 | Tandy |
| 2006/0130344 | A1 | 6/2006 | Schafer |
| 2007/0042128 | A1 | 2/2007 | Waterfield |
| 2007/0220769 | A1 | 9/2007 | Oehlke et al. |
| 2007/0289425 | A1 | 12/2007 | Chen Lin |
| 2009/0158602 | A1 | 6/2009 | Lockyer |
| 2011/0047804 | A1 | 3/2011 | Thomas et al. |
| 2016/0067873 | A1 | 3/2016 | Dickinson et al. |

FOREIGN PATENT DOCUMENTS

| | | |
|---|---|---|
| DE | 202010016333 | 3/2011 |
| EP | 1322809 B1 | 12/2005 |
| EP | 1613804 B1 | 11/2008 |
| FR | 2720309 | 12/1995 |
| KR | 2009059178 | 6/2009 |
| WO | WO 97/28932 | 8/1997 |
| WO | WO 2002/029147 | 4/2002 |
| WO | WO 2004/092473 | 10/2004 |

OTHER PUBLICATIONS

European Patent Application No. 17866992.5; Extended European Search Report dated Mar. 11, 2020, 8 pages.

AudreysSewingBasket.com. Website, http://audreysewingbasket.com, originally downloaded Feb. 11, 2010, 3 pages total.

Create for Less. On-line catalog, http://www.createforless.com, originally downloaded Jan. 26, 2010, 20 pages total.

Hancock's of Paducah. Item List—Rulers. On-line catalog, http://www.hancocks-paducah.com, originally downloaded Apr. 20, 2010, 3 pages total.

Quality Sewing & Vacuum Top Tools: Audrey's "No Wobble Ruler". Quality Sewing Blog, http://shopqualitysewing.com, originally downloaded Feb. 11, 2010, 2 pages total.

Quilting Tools & Accessories. Rotary Cutting Grids & Rulers. On-line catalog, http://www.ericas.com, originally downloaded Jan. 26, 2010, 14 pages total.

Quilt Patterns. Quilt Cutting Guides and Tools. Website, http://www.quiltpatterns.org, originally downloaded Apr. 20, 2010, 3 pages total.

Save on Crafts. Quilting Rulers & Grids. On-line catalog, http://www.save-on-crafts.com, Apr. 20, 2010, 2 pages total.

Westalee Design. Adjustable Rulers. On-line catalog, http://www.westalee.com.au, originally downloaded Apr. 20, 2010, 8 pages total.

Whelan, S. Adjustable Rulers for Accurate Cutting of Quilt and Patchwork Pieces. Review: Quilting Ruler with Locking Fabric Guide; http:/quilting.suite101.com, originally downloaded Aug. 6, 2008, 5 pages total.

U.S. Appl. No. 15/280,747, filed Sep. 29, 2016.

U.S. Appl. No. 12/584,015, filed Aug. 28, 2009.

Crooked Creek Quilt Shop. No Rock Ruler. Website, http://www.crookedcreekquiltshop.com, originally downloaded Sep. 28, 2016, 2 pages total.

* cited by examiner

CUTTING GUIDE WITH SEAM ALLOWANCE RECESS

This United States Patent Application is a continuation of U.S. patent application Ser. No. 16/054,916, filed Aug. 3, 2018, now U.S. Pat. No. 10,526,747, Jan. 7, 2020, which is a continuation of U.S. patent application Ser. No. 15/280,747, filed Sep. 29, 2016, now U.S. Pat. No. 10,041,206, issued Aug. 7, 2018, which is a continuation of U.S. patent application Ser. No. 12/584,015, filed Aug. 28, 2009, now U.S. Pat. No. 9,458,566, issued Oct. 4, 2016, each hereby incorporated by reference herein.

I. FIELD OF THE INVENTION

Generally, a cutting guide having a seam allowance recess which can be used with a cutting tool to cut a piece of material.

II. BACKGROUND OF THE INVENTION

Conventional cutting guides used measure and cut material typically have a square or rectangular shape with a thickness sufficient to guide a cutting tool along one side to cut material extending beyond the periphery of the cutting guide. The cutting guide may also provide on one or both surfaces a set of visible marks spaced at intervals useful for measurement or placement of the cutting guide on the piece of material to be cut. An example of a conventional cutting guides is described in U.S. Pat. No. 6,925,724.

A substantial problem with conventional cutting guides can be that the surface(s) which engage the piece of material to be cut are substantially flat while the piece of material to be cut may include a seam along with a seam allowance which results in a raised portion in the material to be cut. Placing a conventional cutting guide on a seam, a seam allowance, or other raised area, point or support in the piece of material to be cut can cause a conventional cutting guide to wobble, pivot, or otherwise move in relation to the raised area in the piece of material.

Movement of the cutting guide in relation to a raised area in the piece of material to be cut results in corresponding movement of the side of the cutting guide along which the cutting tool engages to cut the piece of material. If the cutting guide shifts in position as the cutting tool cuts the piece of material a unintended irregularity can be created in the edge of the cut material. Additionally, movement of the cutting guide can result in disengagement of the cutting tool with the cutting guide. The cutting tool may then be free to travel across the material in an unintended direction or cut the hand of the cutting tool user.

Another substantial problem with conventional cutting guides can be that, there is no means other than visible marks on the cutting guide to assist in determining placement of the cutting guide on the piece of material to be cut. Typically, the placement of a conventional cutting guide on a piece of material to be cut is determined by matching visible marks on the cutting guide (or the corners of the cutting guide) with a stitching line or seam in the material to be cut. Additionally, once the placement of the cutting guide on the piece of material to be cut is determined there may be no cutting guide element to fix the placement of the cutting guide in relation to piece of material to be cut. As a result, determination of the location at which to place the conventional cutting guide may be uncertain and the cutting guide may move from the location before cutting of the piece of material is complete.

The inventive cutting guide with a seam allowance recess and inventive methods of using the inventive cutting guide with a seam allowance recess addresses each of the foregoing problems associated with conventional cutting guides and conventional methods of using a cutting guide.

II. SUMMARY OF THE INVENTION

Accordingly, a broad object of the invention can be to provide a cutting guide having a recess of sufficient dimension to receive a seam, a seam allowance, or other raised portion of a piece of material to be cut. The raised portion of the piece of material being received within the recess of the cutting guide reduces or eliminates any point or support on which the cutting guide can pivot or wobble and allows the cutting guide to engage the piece of material to be cut outside of a raised portion with greater uniformity.

A second broad object of the invention can be to provide a recess in a cutting guide of sufficient dimension to receive a seam allowance. The recess can further provide a pair of opposed sides one of which be located to abut the seam allowance to fix the location of the cutting guide in relation to the piece of material to be cut.

Naturally, further objects of the invention are disclosed throughout other areas of the specification, drawings, photographs, and claims.

III. A BRIEF DESCRIPTION OF THE DRAWINGS

Figure 3:
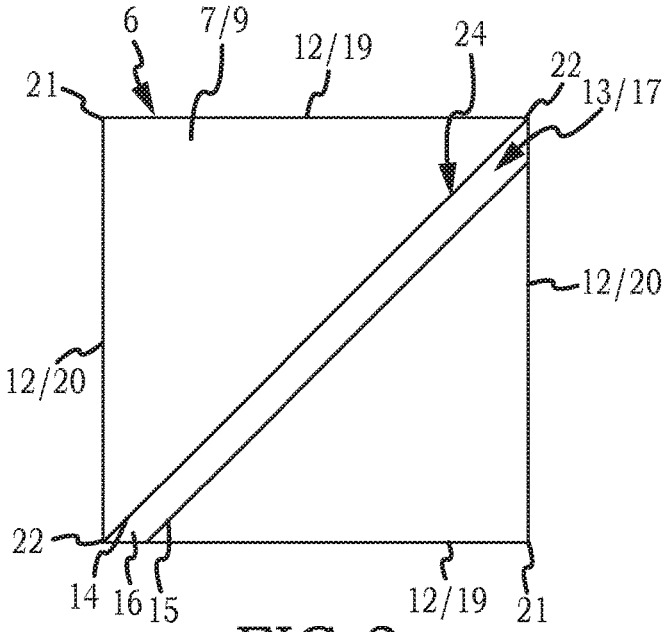
FIG. 3 is bottom plan view of a particular embodiment of the inventive cutting guide having a recess.
Figure 4:
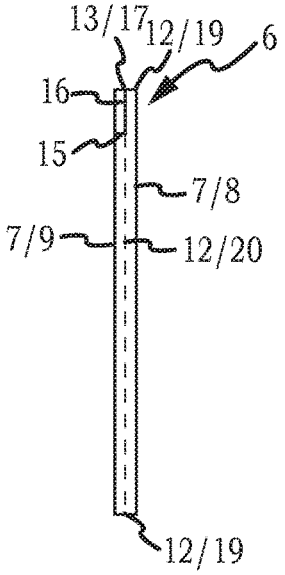

FIG. 4 a side view of the particular embodiment of the inventive cutting guide having a recess shown in FIG. 3.

Figure 5:
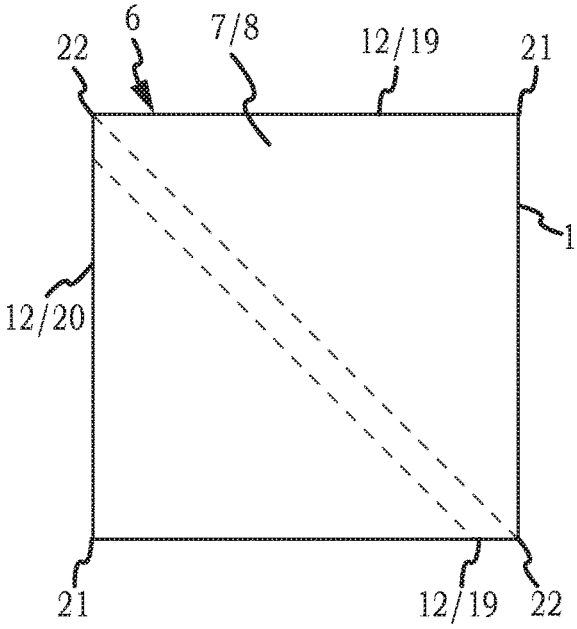

FIG. 5 is a top plan view of the particular embodiment of the inventive cutting guide having a recess shown in FIG. 3.

Figure 6:
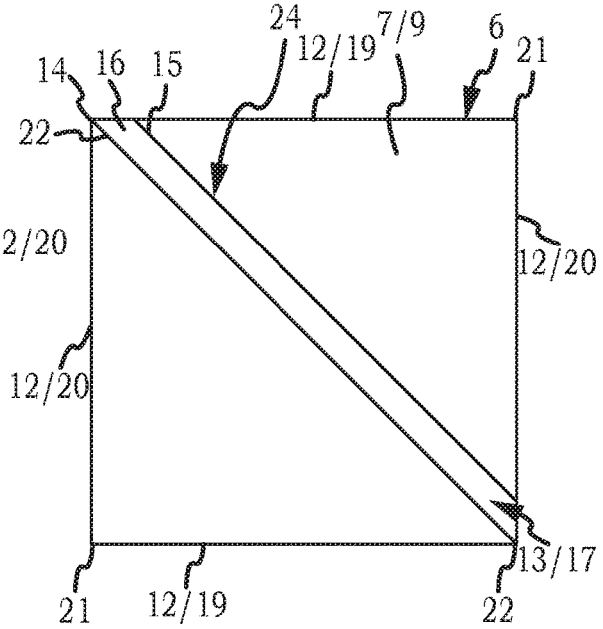

FIG. 6 is a bottom plan view of another particular embodiment of the inventive cutting guide having a recess.

Figure 7:
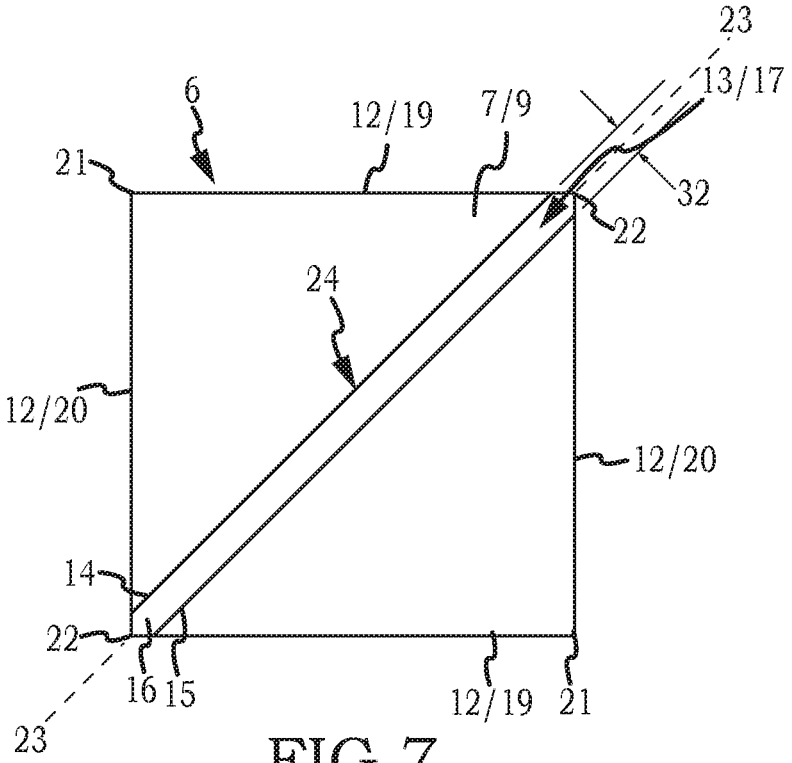

FIG. 7 is a bottom plan view of another particular embodiment of the inventive cutting guide having a recess.

Figure 8:
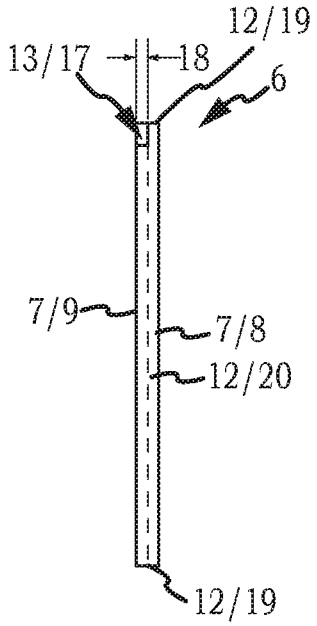

FIG. 8 is a side view of the particular embodiment of the inventive cutting guide having a recess shown in FIG. 7.

Figure 9:
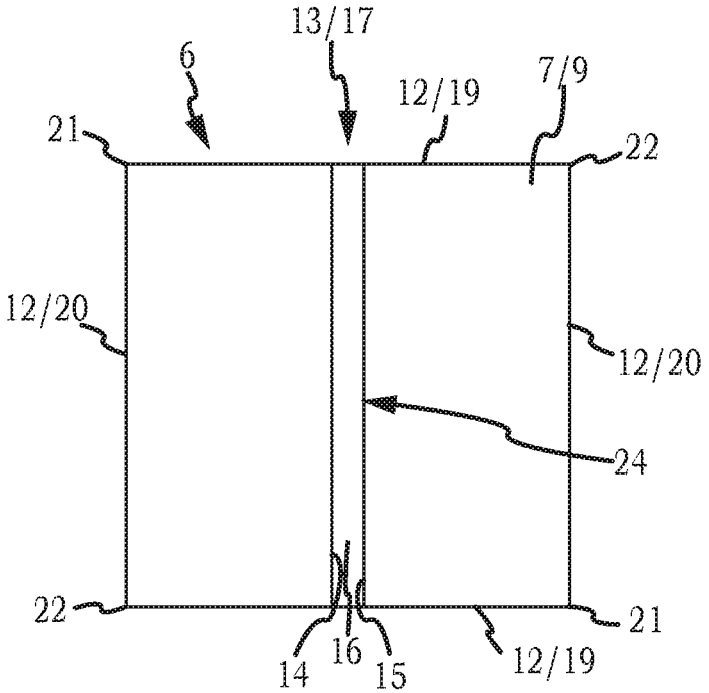

FIG. 9 is a bottom plan view of another particular embodiment of the inventive cutting guide having a recess.

Figure 10:
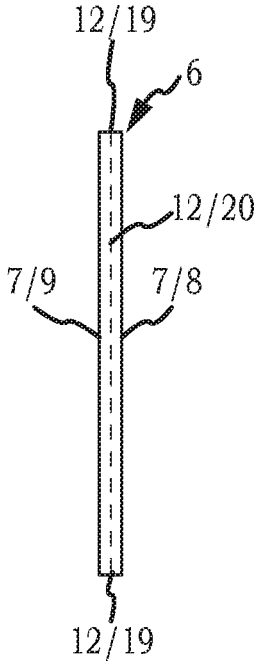

FIG. 10 is a side view of the particular embodiment of the inventive cutting guide shown in FIG. 9.

Figure 11:
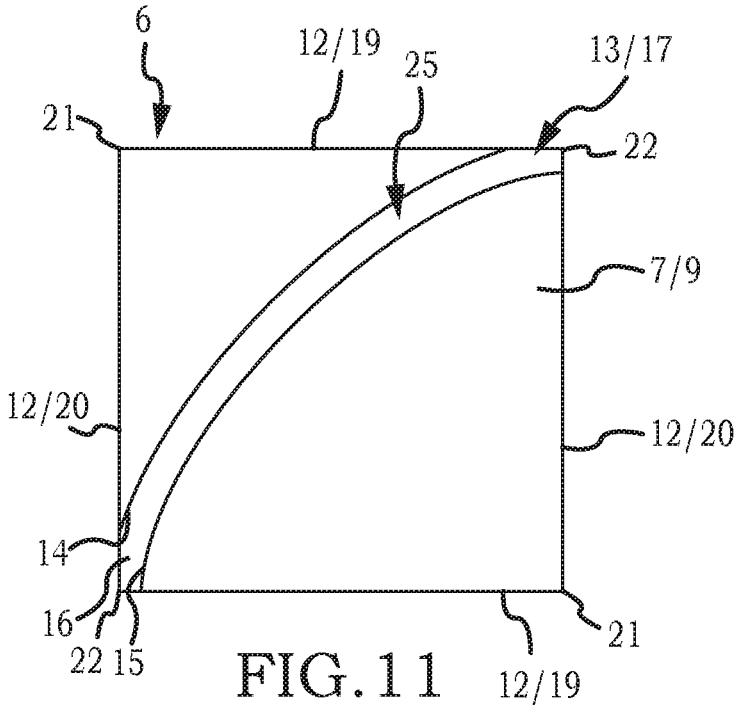

FIG. 11 is a bottom plan view of another particular embodiment of the inventive cutting guide having a recess having an amount of curvature.

Figure 12:
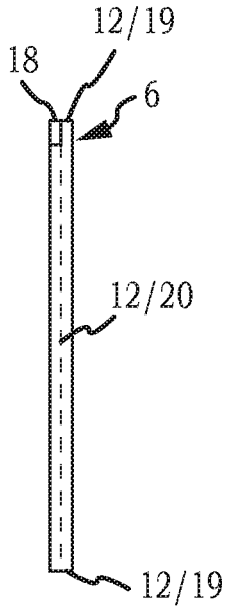

FIG. 12 is a side view of the particular embodiment of the inventive cutting guide having a recess shown in FIG. 11.

Figure 13:
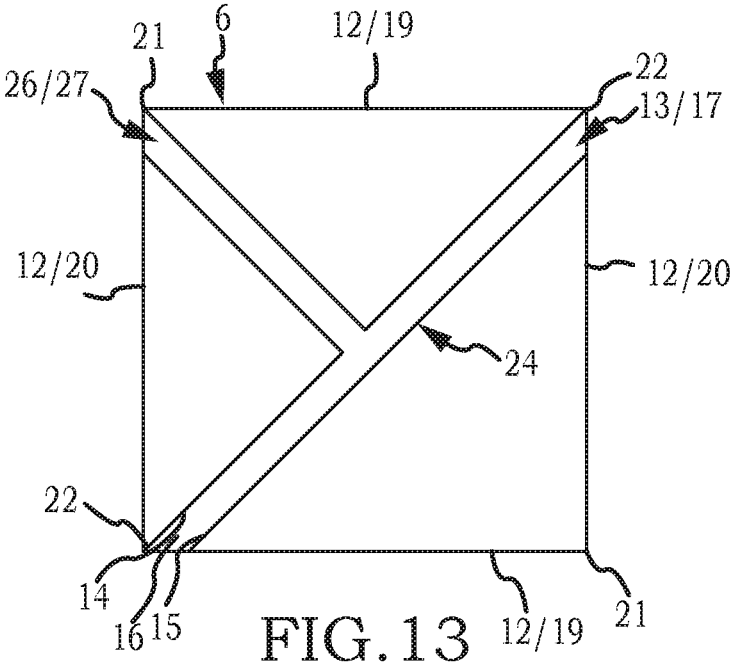

FIG. 13 is a bottom view of another particular embodiment of the inventive cutting guide having a first recess and a second recess.

Figure 14:
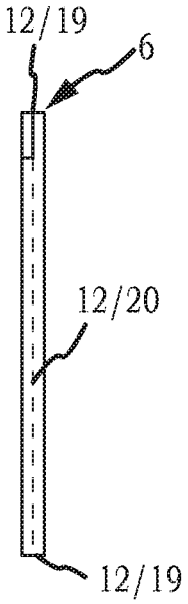

FIG. 14 is a side view of the particular embodiment of the inventive cutting guide having a first recess and a second recess shown in FIG. 13.

Figure 15:
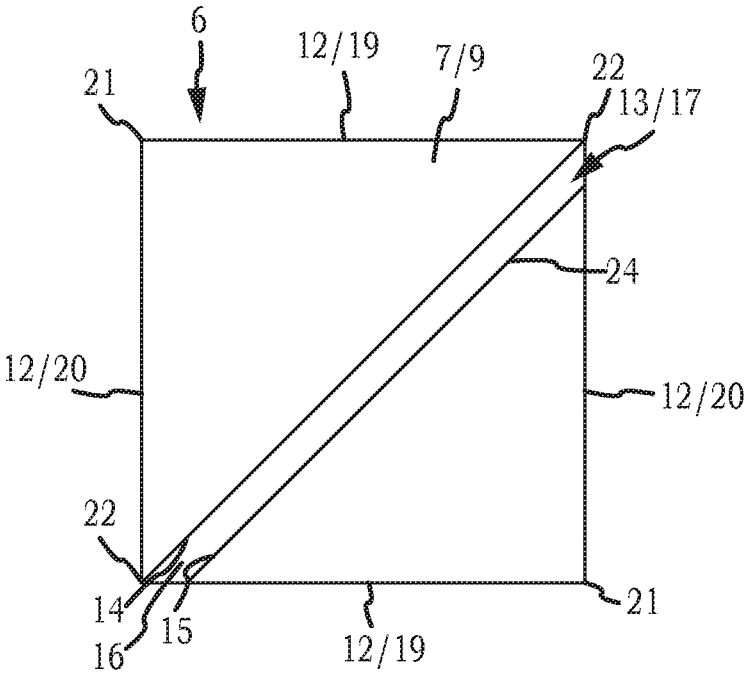

FIG. 15 is bottom plan view of another particular embodiment of the inventive cutting guide having a first recess disposed in the bottom surface of the body of the cutting guide and a second recess disposed in the top surface of the body of the cutting guide.

Figure 16:
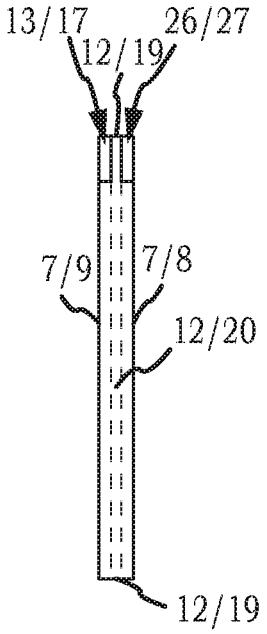

FIG. 16 is a side view of the particular embodiment of the inventive cutting guide having a first recess and a second recess as shown in FIG. 15.

Figure 17:
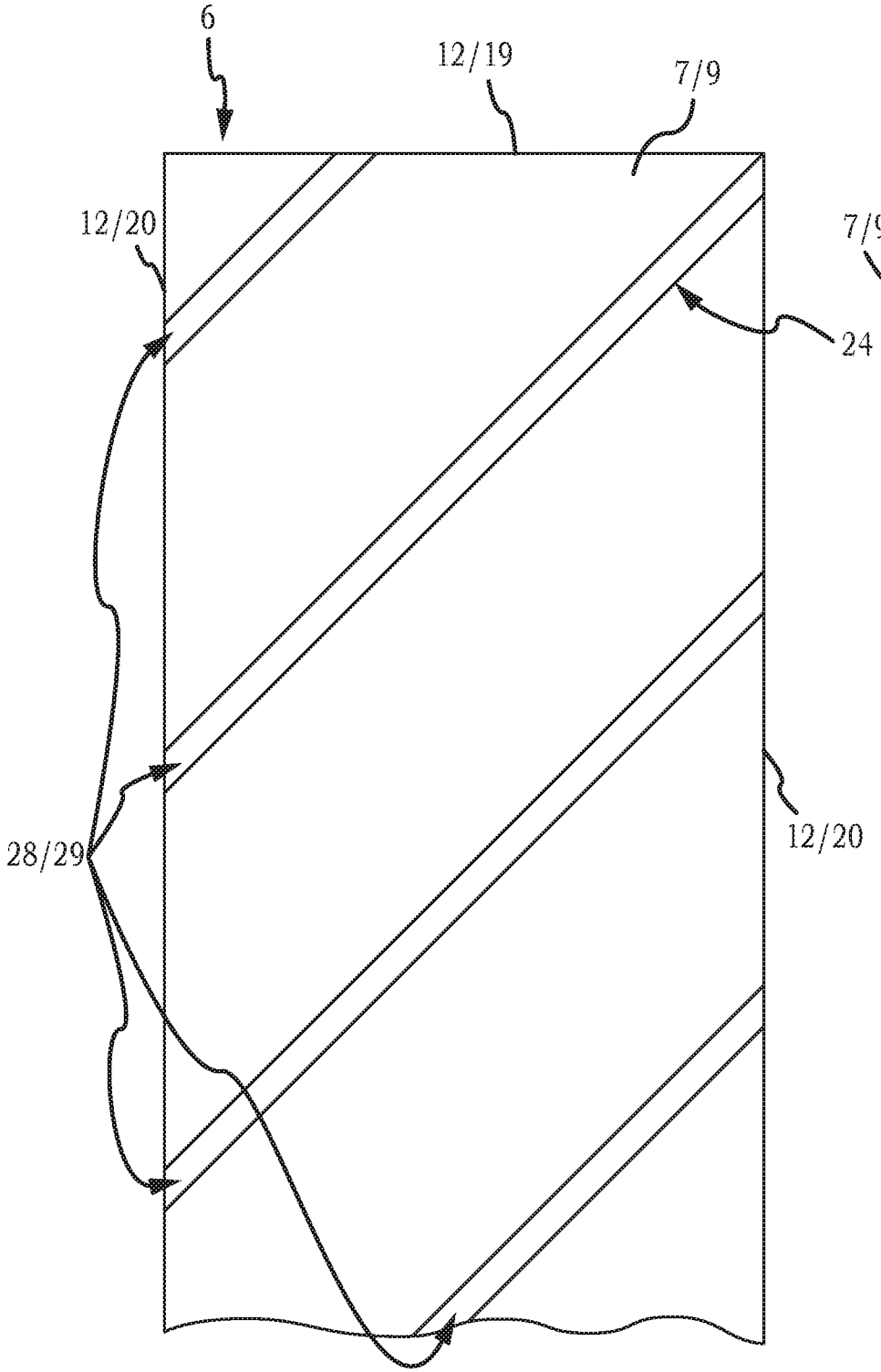

FIG. 17 is a bottom plan view of another particular embodiment of the inventive cutting guide having a plurality of recesses.

Figure 18:
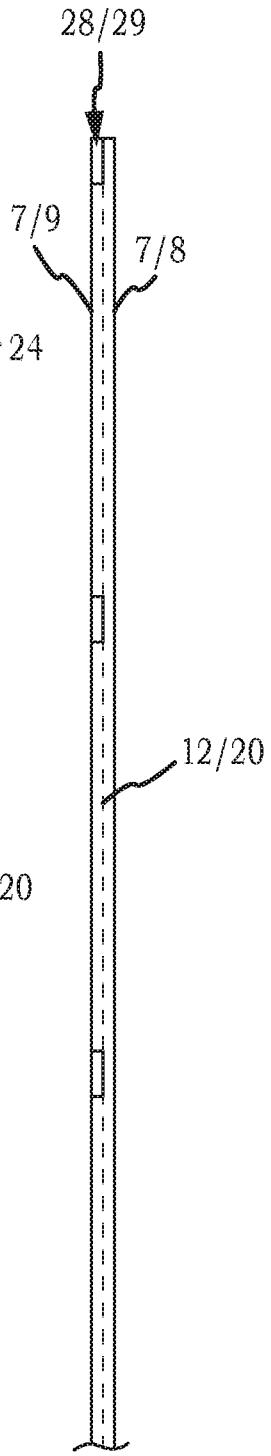

FIG. 18 is a side view of the particular embodiment of the inventive cutting guide having a plurality of recesses as shown in FIG. 17.

IV. DETAILED DESCRIPTION OF THE PREFERRED EMBODIMENTS

A cutting guide (6) having a seam allowance (2) recess (13) and methods of cutting a piece of material (1) with such cutting guide (6).

Figure 1:
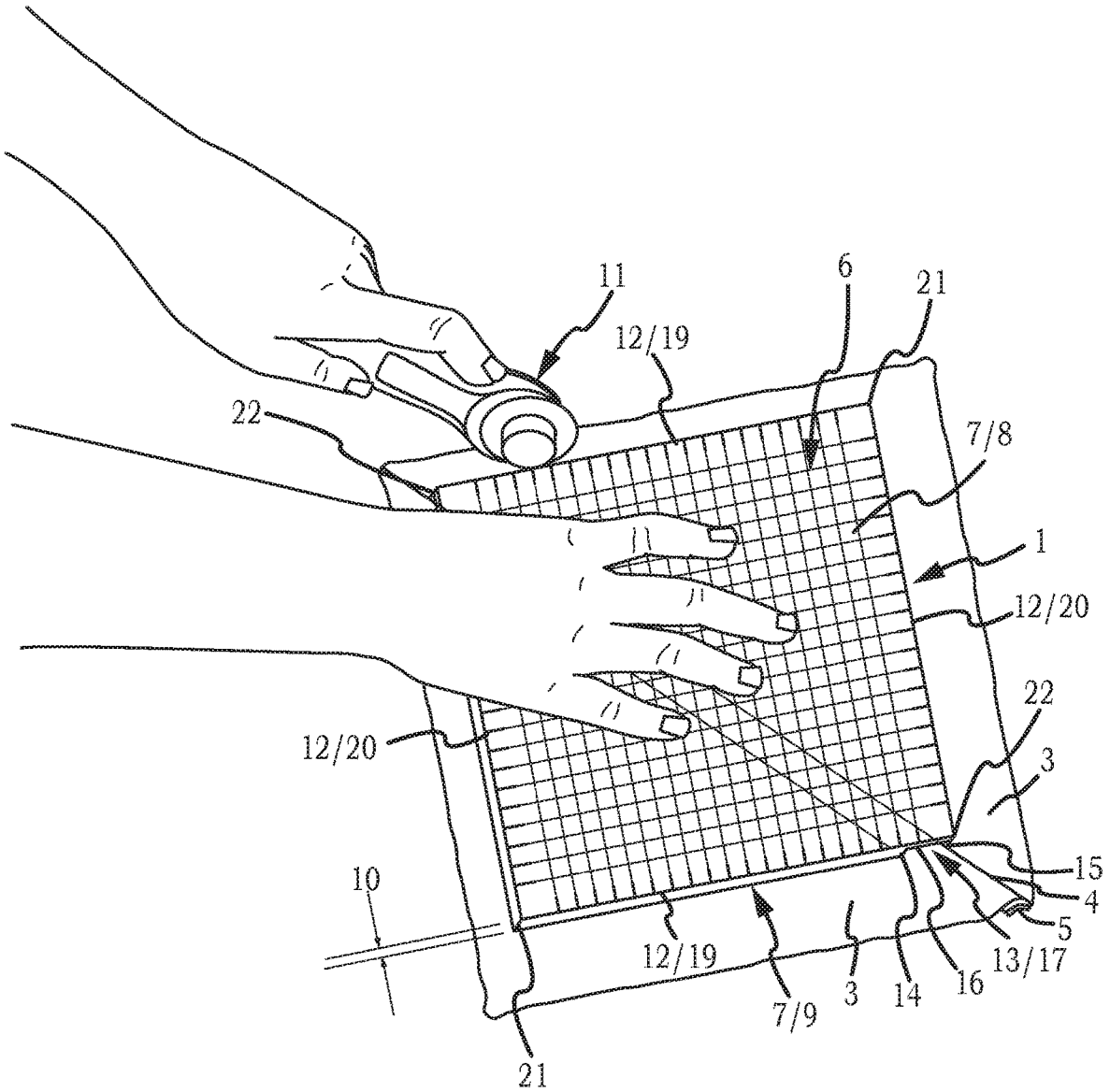
FIG. 1 shows a particular method of cutting a piece of material using an embodiment of a cutting guide having a recess of sufficient dimension to receive a seam allowance of a piece of material.
Figure 2:
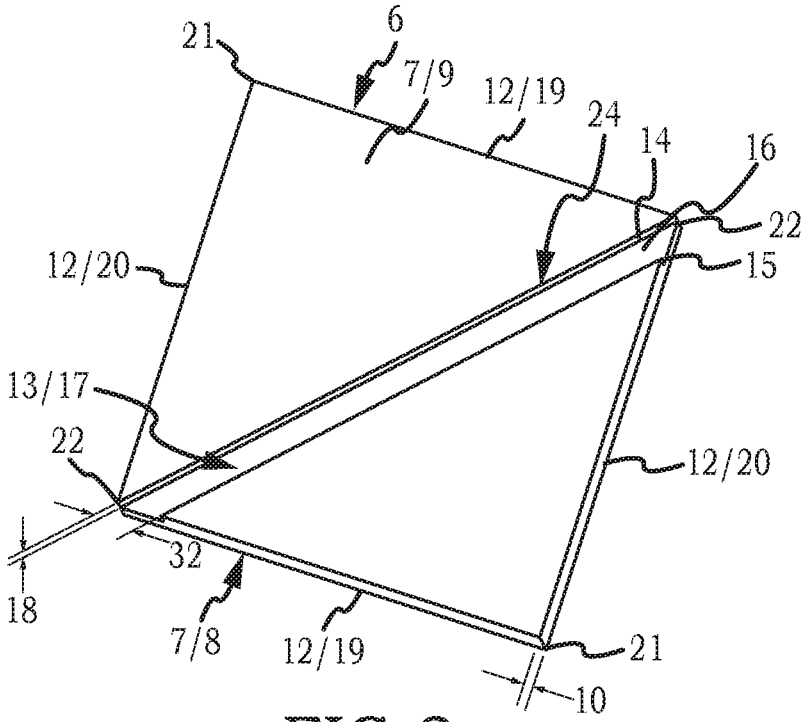
FIG. 2 is perspective view of a particular embodiment of the inventive cutting guide having a recess shown in FIG. 1.

Now referring primarily to FIG. 1, a particular method of cutting a piece of material (1) is illustrated. In one step the inventive method includes providing a piece of material (1) having a seam allowance (2) at which a pair of materials (3) join at a seam (4). The pair of materials (3) for the purposes of this invention means any manner of materials which can be joined by stitching or sewing (or other method such as application of heat or pressure) usually near the edge of the materials such as woven fabric whether of natural or synthetic fibers, leather, cloth, plastic, or the like. The area between the edge of the pair of materials (3) (or plurality of materials) and the stitching line or seam (4) is referred to herein as the seam allowance (2). The seam allowance (2) can range from about one-quarter inch wide (about 6.35 mm) to as much as several inches wide. Typically, however, the seam allowance (2) will have a range of about one-quarter inch and about five eighths inch. For the purposes of this invention the term "seam allowance (2)" also includes the flaps of material (5) between the edge of the pair of materials (3)(or plurality of materials) and the seam (4)(or stitching line) at which the pair of materials (3) (or plurality of materials) join. In another step of the inventive method, the flaps of material (5) can be folded or located on one side of the seam (4) at which the pair of materials (3)(or plurality of materials) join.

Again referring primarily to FIG. 1, the particular method of cutting a piece of material (1) can further include the step of providing a cutting guide (6). The cutting guide (6) can include (as further described below) a body (7) with a top surface (8) disposed in substantially parallel opposed relation to a bottom surface (9) having a thickness (10) sufficient to guide a cutting tool (11) along one of a plurality of sides (12) of the body (7). A recess (13) having a pair of opposed sides (14)(15) and a cross member (16) can be disposed in the bottom surface (9) (or top surface (8)) of the body (7) of the cutting guide (6). The recess (13) can define a passage (17) which communicates with at least one of the plurality of sides (12) of the body (7) of the cutting guide (6). The recess (13) can have dimensions sufficient to receive the seam allowance (2) of the pair of materials (3)(or plurality of materials) joined at the stitching line or seam (4) and as to certain embodiments the recess (13) can receive the seam allowance (2) with the flaps of the material (5) located or folded to one side of the seam (4).

Again referring primarily to FIG. 1, the particular method of cutting a piece of material (1) can further include the step of engaging the bottom surface (9)(or the top surface (8)) depending on which surface (8)(9) the recess (13) is disposed in) of the cutting guide (6) with the piece of material (1) such that the seam allowance (2) can be received within the recess (13) disposed in the cutting guide (6). By receiving the seam allowance (2) in the recess (13), the bottom surface (9) (or the top surface (8)) of the cutting guide (6) can engage the piece of material (1) on either side of the seam allowance (2). Particular embodiments of the method can further include the step of abutting one of the pair of opposed sides (14)(15) of the recess (13) against the seam (4) of the piece of material (1).

Again referring primarily to FIG. 1, the particular method of cutting a piece of material (1) can further include the step of guiding a cutting tool (11) along one or more of the plurality of sides (12) of the cutting guide (6) engaged with the piece of material (1) to receive the seam allowance (2) in the recess (13) and in a further step cutting the piece of material (1) extending beyond one or more of the plurality of sides (12) with the cutting tool (11) guided along one said plurality of sides (12) of the cutting guide (6).

Now referring primarily to FIGS. 2-5, which show a particular embodiment of an inventive cutting guide (6). The cutting guide (6) can include a body (7) having a top surface (8) disposed in substantially parallel opposed relation to a bottom surface (9) having a thickness (10) sufficient to guide a cutting tool (11)(as shown in FIG. 1 as an example) along one of a plurality of sides (12) of the body (7). The cutting guide (6) can further include a recess (13) having a pair of opposed sides (14)(15) with a cross member (16) coupled between the opposed sides (14)(15) disposed in the bottom surface (9) of said body (7), the recess (13) defining a passage (17) which communicates with at least one of the plurality of sides (12) of said body (7), the recess (13) having dimensions sufficient to receive a seam allowance (2) of a pair of materials (3) joined at a seam (4) with the bottom surface (9) engaged with the pair of materials (3) on either side of the seam allowance (2)(also see FIG. 1). As to a particular embodiment of the cutting guide (6) shown in FIGS. 2-5, the body can have substantially square or rectangular configuration. The body (7) can be generated from a wide and numerous variety of materials such as metal, plastic, wood, or the like. The recess (13) disposed in the bottom surface (9) or the top surface (8) of the cutting guide (6) can, as non-limiting examples, be generated by molding the cutting guide (6) with the recess (13) as one piece in a mold, fabricating the cutting guide (6) in two or more layers which can be assembled to provide the recess (13), or cutting the recess (13) into the body (7) by removing material from the body (7). The thickness (10) of the body (7) sufficient to guide a cutting tool (11) while typically in the range of about one eighth inch to about five eighths inch is not so limited, and depending upon the application, the body (7) can have a greater or lesser thickness (10). Similarly, while the opposing sides (14)(15) of the recess (13) will typically be located in opposed relation a distance apart (32) in the range of about one-quarter inch and about three quarters inch, the invention is not so limited, and depending upon the application the opposing sides (14)(15) of the recess can be a greater or lesser distance (32) apart. The opposed sides (14)(15) will typically connect with the bottom surface (9)(or the top surface (8)) of the body (7) in substantially perpendicular relation and further connect with the cross member (16) in substantially perpendicular relation to provide a recess (13) of open square or rectangular configuration. The depth (18) of the recess (13) will typically be in a range of about one sixteenth inch and about five sixteenths inch; however, the invention is not so limited, and the dimensional relations of the recess (13) can be adjusted such that the seam allowance (2)(typically comprising the thickness of the two flaps of material (5) folded to one side of the seam (4) and the thickness of the joined material (3)) can be received within the recess (13) coincident with engagement of the bottom surface (9)(or the top surface (8)) with the surface of the joined pair of materials (3). Locating the seam allowance (2) within the recess (13) allows one of the surfaces (8)(9) of the cutting guide (6) to engage the joined pair of materials (3) without the seam allowance (2) acting as a point or support on which the cutting guide (6) pivots, wobbles or otherwise prevents fixed engagement of the cutting guide (6) with the joined pair of materials (3)(see also FIG. 1).

Again referring primarily to FIGS. 2-8, particular embodiments of the cutting guide (6) shown further includes a recess (13) which defines a passage (17) which communicates between at least two of the plurality of sides (12) of the body (7). Where the body (7) has a substantially rectangular configuration with two pairs of opposed sides (19)(20) and a corresponding two pairs of diagonally opposed corners (21)(22) the recess (13) can define a passage (17) which communicates between one of the two pairs of diagonally opposed corners (21)(22) of the body (7). Referring specifically to FIGS. 7 and 8, as to particular embodiments, the pair of opposed sides (14)(15) of the recess (13) can be located a distance from the diagonal axis (23) which runs between diagonally opposed corners (21) (broken line shown in FIG. 7 as an example). Now referring specifically to FIGS. 2-5, as to other embodiments of the invention, one of the opposed sides (14) of the recess (13) can intersect with both of the diagonally opposed corners (21).

Now referring primarily to FIGS. 9 and 10, which shows a particular embodiment of the cutting guide (6) which provides a body (7) having a substantially rectangular configuration with two pairs of opposed sides (19)(20) in which the recess (13) disposed in the bottom surface (9) defines a passage (17) which communicates between one of the two pairs of opposed sides (19) of said body (7).

Each of the embodiments of the invention shown in FIGS. 1-8 provide a recess (13) having substantially linear parallel opposed sides (24); however, the invention is not so limited and as shown for example in FIGS. 11-12 the recess (13) as to certain embodiments can provide opposed sides (14)(15) having an amount of curvature (25).

Now referring primarily to FIGS. 13-18, certain embodiments of the invention can further include a second recess (26) having a pair of opposed sides (14)(15) and a cross member (16) disposed in the bottom surface (9) of the body (7)(or the top surface (8)). The second recess (26) can have dimensions sufficient to receive the seam allowance (2) of a pair of materials (3) joined at a seam (4) with said bottom surface (9) engaged with said pair of materials (3) on either side of said seam allowance (2). As to the embodiment shown in FIGS. 13-14, the second recess (26) defines a second passage (27) which can communicate between said first recess (13) and at least one of said plurality of sides (12) of the body (7). Extending the second recess (26) would result in an embodiment which defines a second passage (27) which communicates with the first recess (13) and two of the plurality of sides (12) of the body (7). Certain embodiments can provide the body (7) having a substantially rectangular configuration with two pairs of opposed sides (19)(20) and a corresponding two pairs of diagonally opposed corners (21)(22) in which the second recess (26) defines a passage which communicates between one of the two pairs of opposed sides (19) and the first recess (13) communicates between the second of the two pairs of opposed sides (20)(not shown). Again, certain embodiments can provide a second recess (26) which defines a passage (27) which communicates between one of said two pairs of diagonally opposed corners (21)(22). One of said opposed sides (14) of the second recess (26) which communicates between one of said two pairs of diagonally opposed corners (21) of the body can intersect both of said diagonally opposed corners (21).

Now referring primarily to FIGS. 15 and 16, certain embodiments of the invention can provide a first recess (13) and a second recess (27) disposed on opposed sides of the body (7) of the cutting guide (6). Each of the first recess (13) and the second recess (27) can have a pair of opposed sides (14)(15) and a cross member (16) defining a first passage (17) and a second passage (27) each of which communicates with at least one of said plurality of sides (12) of said body (7) with each recess (13)(27) having dimensions sufficient to receive a seam allowance (2) of a pair of materials (3) joined at a seam (4) with the corresponding top surface (8) or bottom surface (9) engaged with said pair of materials (3) on either side of said seam allowance (2). While the embodiment shown in FIGS. 15 and 16, show the first recess (13) and the second recess (27) disposed in the opposed top and bottom surfaces (7)(8) having substantially the same overlaying configuration; the invention is not so limited, and the first recess (13) can have substantially different configuration or placement on the top surface (8) than the second recess (27) disposed in the bottom surface (9).

Now referring primarily to FIGS. 17 and 18, certain embodiments of the inventive cutting guide (6) can provide a elongate rectangular body (7) having a thickness sufficient to guide a cutting tool (11)(as shown in FIG. 1) along one of a plurality of sides (12) of the body (7). A plurality of recesses (28) having a pair of opposed sides (19)(20) and a cross member (16) can be disposed in the bottom surface (9)(or the top surface (8) or both surfaces) of the body (7). Each of the plurality of recesses (28) can define a corresponding plurality of a passages (29) which communicates between opposed sides (30)(31) of the body (7). Each of the plurality of recesses (28) can have dimensions sufficient to receive a seam allowance (2) of a pair of materials (3) joined at a seam (4) with the corresponding surface (8)(9) engaged with said pair of materials (3) on either side of said seam allowance (2).

As to each of the examples of the inventive cutting guides (6) shown in the Figures, the bottom surface (9) or the top surface (8) or both can further include graphic indicia or numeric indicia (not shown) imprinted or applied to the surface for instruction, placement or measurement.

As can be easily understood from the foregoing, the basic concepts of the present invention including the best mode may be embodied in a variety of ways. The invention involves numerous and varied embodiments of a cutting guide (6) and methods of making and using such cutting guide (6).

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "recess" should be understood to encompass disclosure of the act of "recessing"—whether explicitly discussed or not—and, conversely, were there effectively disclosure of the act of "recessing", such a disclosure should be understood to encompass disclosure of a "recess" and even a "means for recessing." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the cutting guides disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below are intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A cutting guide, comprising:

a substantially rectangular body having a top surface disposed in opposed relation to a substantially flat bottom surface, said top surface and said bottom surface extending to each of a plurality of sides of said substantially rectangular body, said substantially rectangular body having a thickness sufficient to guide a cutting tool along one of a plurality of sides of said body; a first recess and a second recess disposed in said bottom surface of said body, said first recess and said second recess each having a pair of opposed sides joined by a cross member, wherein said first recess defining a first passage intersecting one of a first pair of diagonally opposed corners of said substantially rectangular body;

wherein said second recess defining a second passage intersecting one of a second pair of diagonally opposed corners of said substantially rectangular body; and wherein said first recess defining said first passage intersects said second recess defining said second passage.

2. The cutting guide of claim 1, wherein one of said pair of opposed sides of said first recess intersecting one of said first pair of diagonally opposed corners.

3. The cutting guide of claim 2, wherein one of said pair of opposed sides of said second recess intersecting one of said second pair of diagonally opposed corners.

4. The cutting guide of claim 3, wherein said opposed sides of said first recess and said second recess comprise substantially linear parallel opposed sides.

5. The cutting guide of claim 4, wherein said first and second recesses have dimensions sufficient to receive a seam allowance of a pair of materials joined at a seam with said bottom surface of said substantially rectangular body engaged with said pair of materials on either side of said seam allowance.

6. The cutting guide of claim 5, further comprising viewable indicia disposed on said bottom surface or said top surface.

7. A method of making a cutting guide, comprising:

providing a substantially rectangular body having a top surface disposed in opposed relation to a substantially flat bottom surface, said top surface and said bottom surface extending to each of a plurality of sides of said substantially rectangular body, said substantially rectangular body having a thickness sufficient to guide a cutting tool along one of a plurality of sides of said body;

disposing a first recess and a second recess in said bottom surface of said body, said first recess and said second recess each having a pair of opposed sides joined by a cross member, wherein said first recess defining a first passage intersecting one of a first pair of diagonally opposed corners of said substantially rectangular body;

wherein said second recess defining a second passage intersecting one of a second pair of diagonally opposed corners of said substantially rectangular body; and wherein said first recess defining said first passage intersects said second recess defining said second passage.

8. The method of making a cutting guide of claim 7, further comprising intersecting one of said pair of opposed sides of said first recess with one of said first pair of diagonally opposed corners.

9. The method of making a cutting guide of claim 8, further comprising intersecting one of said pair of opposed sides of said second recess with one of said second pair of diagonally opposed corners.

10. The method of making a cutting guide of claim 9, further comprising disposing said opposed sides of said first recess and said second recess in substantially linear parallel opposed sides.

11. The method of making a cutting guide of claim 10, further comprising configuring said first and second recesses to receive a seam allowance of a pair of materials joined at a seam with said bottom surface of said substantially rectangular body engaged with said pair of materials on either side of said seam allowance.

12. The method of making a cutting guide of claim 11, further comprising disposing viewable indicia on said bottom surface or said top surface.

13. A method of cutting a piece of material, comprising:

obtaining a piece of material, said piece of material including a first piece of material different from a second piece of material joined at a seam having a seam allowance with a width which extends between said seam and an edge of each of said first piece of material and said second piece of material;

obtaining a cutting guide, including:

a substantially rectangular body having a top surface disposed in opposed relation to a substantially flat bottom surface, said top surface and said bottom surface extending to each of a plurality of sides of said substantially rectangular body, said substantially rectangular body having a thickness sufficient to guide a cutting tool along one of a plurality of sides of said body;

a first recess and a second recess disposed in said bottom surface of said body, said first recess and said second recess each having a pair of opposed sides joined by a cross member, wherein said first recess defining a first passage intersecting one of a first pair of diagonally opposed corners of said substantially rectangular body;

wherein said second recess defining a second passage intersecting one of a second pair of diagonally opposed corners of said substantially rectangular body; and wherein said first recess defining said first passage intersects said second recess defining said second passage;

directly engaging said bottom surface of said cutting guide with said first and second pieces of material to locate said seam and said width of said seam allowance entirely between said pair of opposed sides of said first recess and second recess, said first and second pieces of material extending beyond said plurality of sides of said body of said cutting guide;

abutting said seam against one said opposed sides of said first and second recess;

guiding a cutting tool along each of said plurality of sides of said cutting guide; and cutting said piece of material with said cutting tool guided along each of said plurality of sides of said cutting guide.

* * * * *